United States Patent [19]

Woodward

[11] Patent Number: 5,014,995

[45] Date of Patent: May 14, 1991

[54] BOARD GAME APPARATUS

[75] Inventor: Keith Woodward, Kettering, United Kingdom

[73] Assignee: Creative Crusade Limited, Kettering, United Kingdom

[21] Appl. No.: 418,515

[22] Filed: Oct. 10, 1989

[30] Foreign Application Priority Data

Mar. 21, 1989 [GB] United Kingdom ..... 8906434

[51] Int. Cl.[5] ..... A63F 3/02

[52] U.S. Cl. ..... 273/261; 273/285; D21/15; D21/24

[58] Field of Search ..... 273/261, 260, 285, 286, 273/248, 258; D21/15, 24

[56] References Cited

U.S. PATENT DOCUMENTS

D. 123,508 11/1940 Moore ..... 273/248
384,195 6/1888 Duryea ..... 273/261
2,147,900 2/1939 Houseknecht ..... 273/285
3,778,065 12/1973 Hale ..... 273/261

FOREIGN PATENT DOCUMENTS 3214 of 1902 United Kingdom ..... 273/261
620529 3/1949 United Kingdom ..... 273/261

*Primary Examiner*—Benjamin Layno
*Attorney, Agent, or Firm*—Edwin D. Schindler

[57] ABSTRACT

The apparatus comprises a hexagonal board subdivided into a tessellated arrangement of equilateral triangles, and two to four sets of playing pieces, with at least seven pieces in each set. The triangles into which the board is subdivided alternate in type along rows of triangles such that edges of each triangle are parallel to two opposed edges of the hexagon, and the number of any type of triangle along any edge of the hexagon is at least four.

18 Claims, 3 Drawing Sheets

BOARD GAME APPARATUS

BACKGROUND OF THE INVENTION

This invention relates to board games.

Checkers (also known as draughts) is a well-known board game for two players, employing a checkers board and twelve pieces for each player, in which each player moves his pieces in such a way that he attempts to jump over and capture his opponent's pieces.

Checkers is relatively limited, because:

(1). Only two people can play at any one time.

(2). The configuration of the board together with the constraints on types of movement of pieces provide relatively few alternative moves at any turn.

(3). The combination of (1) and (2) results ln relatively predictable events from one game to another.

Board games of the checkers type with a hexagonal playing surface are known. For example, British patent specification 3214/1902 discloses a game board having an irregular hexagonal board which comprises a tessellated arrangement of triangles, enabling two or more players to play. U.S. Pat. No. 3533627 discloses a game with a similar irregular hexagonal board enabling two or three players to play checkers together.

U.S. Pat. No. 384195 discloses a game board with a regular hexagonal board, which is subdivided into a tessellated arrangement of triangles., the triangles are arranged in a specific manner, with all the triangles with bases on the periphery of the hexagon being of the same dark colour.

These games with hexagonal boards have several disadvantages, as follows: In some cases geometrical arrangement of the tessellated triangle patterns leads to inherent biasing of the game ln favour of players starting the game at particular locations on the board., and none of the above configurations show any possible way ln which four players could contest a checkers-like game on equal terms. There are furthermore, only a limited number of arrangements of playing pieces which can be employed for a two-player game, and the board is bulky and usable on one face only.

SUMMARY OF THE INVENTION

I have now devised a board game, which while retaining some of the characteristics of the traditional game of checkers, contains new features which provide an improvement relative to the traditional game by:

(1). Allowing for 2,3 or 4 players.

(2). Providing a greater number of alternative moves, to offer greater scope for decision-making, strategy and skill.

(3). Providing the potential for events on the board to be more varied and less predictable.

According to the present invention, there is provided game apparatus comprising:

(a) a game board having a playing configuration provided on the surface of the board, the playing configuration comprising a hexagon subdivided into a tessellated arrangement of equilateral triangles which alternate in type along the entire length of all rows thereof, the edges of each triangle being parallel to two opposed edges of said hexagon, the number of either type of said triangles contiguous with each edge of said hexagon being at least four; and (b) two to four sets of playing pieces, each set comprising at least seven said pieces.

The term "parallel" as used herein encompasses contiguity, whereby edges of said triangles are contiguous with (and thereby define) the edges of the hexagon.

The two types of triangle are generally represented by different colours; for example, one type of triangle may be light in colour ("white") and the other type may be darker in colour ("black").

Preferably, each set of playing pieces comprises ten pieces, such that each set can be arranged at the start of a game with four pieces on alternating triangles in a row along one edge, with three pieces along the next inner row on alternating triangles of the same type as the alternating triangles in the edge row, and with two pieces and one piece, respectively, in the next two rows.

Preferably all the pieces in each set are identical; there may be a first set of a first colour (such as red), a second set of a second colour (such as blue), a third set of a third colour (such as yellow) and a fourth set of a fourth colour (such as green). It is also preferred that the game apparatus further comprises means for indicating enhanced value for at least some of the pieces in at least some of the sets of pieces, in accordance with rules for the game.

In a first embodiment of the invention, the hexagon may be regular in shape and divided into 96 of the triangles (48 of each type). In a second embodiment, the hexagon may be irregular and comprise sides of lengths comprising, successively, in order around the periphery of the hexagon, four, five, five, five, four and six edges of said triangles; this arrangement is such that only one axis through non-adjacent sides of the hexagon is parallel to any side of the hexagon.

In a particularly preferred embodiment of the invention, the game board is reversible and provided with a regular hexagon (as described above with reference to the first embodiment) on one face thereof and an irregular hexagon (as described above with reference to the second embodiment) on the other face thereof.

It is further preferred that the board (whether or not it is reversible), should be provided with one slit extending from an apex of the hexagon along edges of triangles of the two types, and five radial hinged edges extending from the remaining five apices along edges of triangles of the two types to a point at which six triangles meet, such that the board can be folded into six stacked triangular flaps each of which contains at least 16 of the above mentioned triangles.

DESCRIPTION OF A PREFERRED EMBODIMENT

Apparatus according to the invention may be used for a game according to the following rules.

(a) The board

Figure 1:
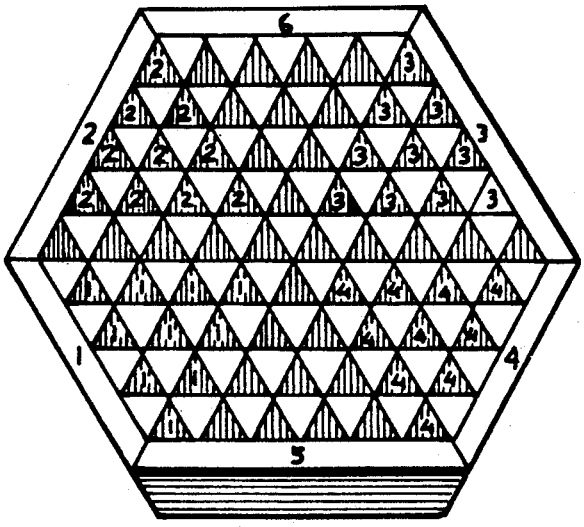
FIG. 1 is a plan view of one face of a board for use in the game apparatus according to the invention, showing the arrangement of pieces at the beginning of a four-player game.
Figure 2:
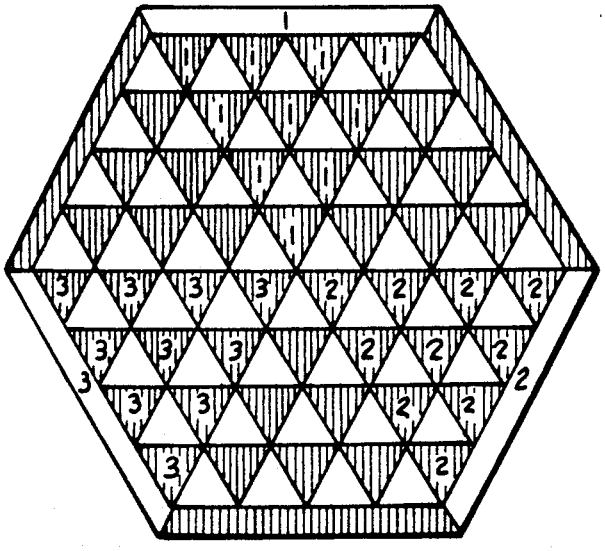
FIG. 2 is a plan view of the obverse face of a board for use in the game apparatus according to the invention, showing the arrangement of pieces at the beginning of a three-player game.

The board is reversible and has on respective faces a different pattern of tessellated triangles forming a hexagonal shape. FIG. 1 shows the pattern on one face of the board and FIG. 2 shows the pattern on the other face of the board. The numbers 1,2,6,3,4,5, respectively, around the edges of the board in the drawings, indicate different coloured strips (say of red, blue, black, yellow, green, black, respectively). The numbered triangles 1,2,3 and 4 represent playing pieces of four respective colours (such as red, blue, yellow and green) set up ready for the game to begin. Thus FIG. 1 shows a suitable arrangement at the start of a four-player game, each player having ten pieces of one colour, while FIG. 2 shows a suitable arrangement at the start of a three-player game, each player again having ten pieces.

The board folds up by hinging together six triangular flaps on five edges, in such a way that they can be unfolded to form a flat hexagonal board or folded so that each flap overlaps, and is overlapped by, its adjacent flap to form a neat stack of six triangular flaps.

FIGS. 9*a*, 9*b*, 9*c*, 9*d*, 9*e*, and 9*f* illustrate one possible sequence for folding the game board into a stack of six triangular flaps.

Figure 3:
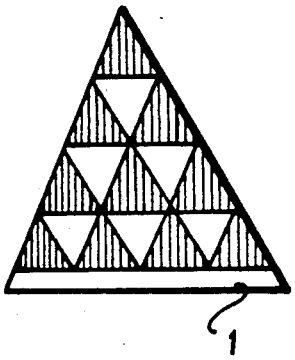
FIG. 3 is a plan view of the board of FIG. 1, when folded up ln the form of a stack.
Figure 4:
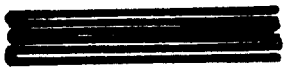
FIG. 4 is a side elevation of the stack of FIG. 3.

FIG. 3 is a plan view of the top flap on the stack when they are folded, the top flap in the embodiment illustrated constituting part of the board of FIG. 2. The board has a radial slit along a line between rows of triangles on each face of the board, and five similar axial fold lines, such that the whole board can be folded into six layers as shown. FIG. 4 is a side elevation of the stack showing how the six flaps are hinged together.

(b) The playing pieces

Figure 6A:
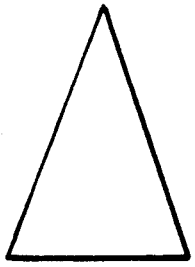
FIGS. 6*a* and 6*b* are respectively front elevation of a playing piece.
Figure 6B:
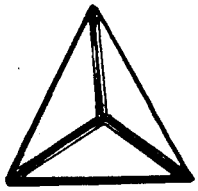

Forty hollow tetrahedrons of 10×4 different colours are employed (typically red, blue, yellow and green). Each player will use tetrahedrons (or Tri's as they will henceforth be called) of one colour only. The shape of these Tri's is shown in FIGS. 6*a* and 6*b*. The Tri's are placed hollow side down during play (and may be stacked inside one another for efficient storage when not in use).

Figure 7:
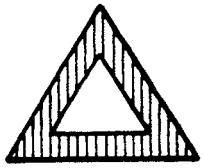
FIG. 7 is a plan view of a "crown" for use with a playing piece as illustrated in FIGS. 6*a* and 6*b;*
Figure 8:
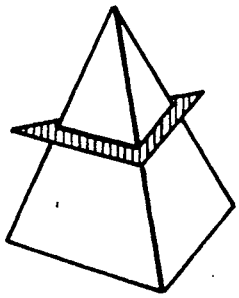
FIG. 8 is a perspective view showing a crown as shown in FIG. 7 located on a playing piece and FIGS. 9*a*, 9*b*, 9*c*, 9*d*, 9*e* and 9*f* each show either a plan view or perspective view of a sequence for folding the game board of the present invention.
Figure 9A:
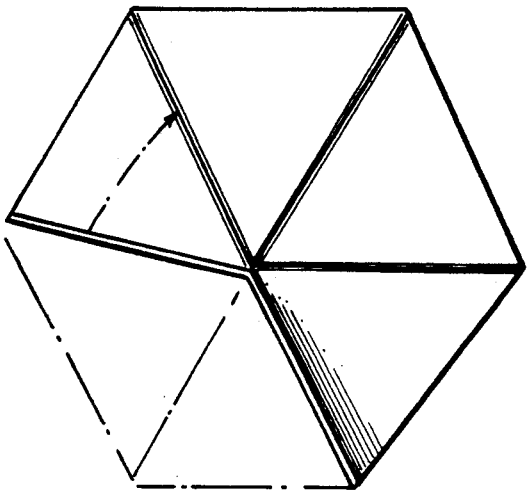
Figure 9B:
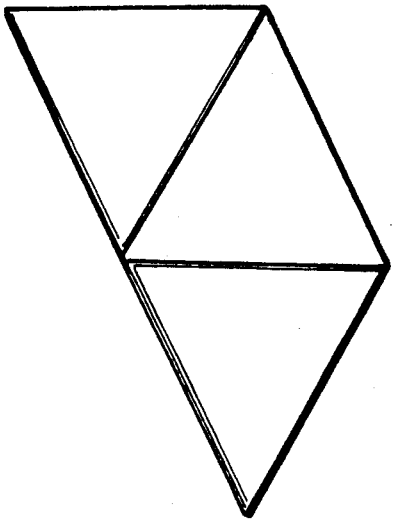
Figure 9C:
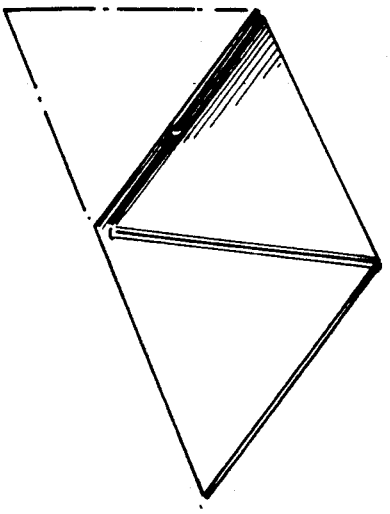
Figure 9D:
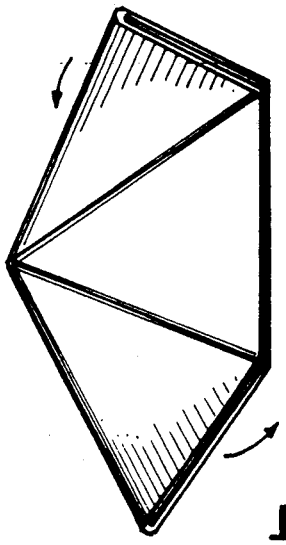
Figure 9E:
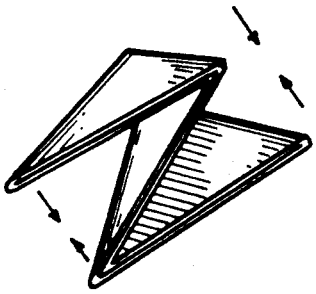
Figure 9F:
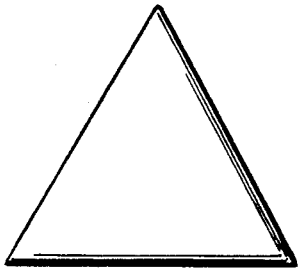

There are also twenty flat triangular shapes (crowns) included in the game; see FIG. 7. These are to signify that a Tri has been promoted to enhanced value during the game and are placed on the Tri's as illustrated in FIG. 8.

(c) Setting up the board

If there are 2 or 3 players, use the face of the board with three coloured edges and the larger triangles (see FIG. 2). Each player arranges ten triangular pyramids (or Tri's) against the edge of matching colour as shown in the diagram. If there are 4 players, use the face of the board with four coloured edges and the smaller triangles. Each player arranges ten Tri's as shown ln FIG. 1.

(d) How to win

The object of the game is to try to capture all of your opponents pieces. When pieces are captured they are removed from the board. The winner is the last player to have pieces remaining on the board. If a position is reached where all the remaining players agree that a decisive result cannot be achieved, then the winner is that remaining player who has captured the most pieces. If, after this rule is applied, there is still a tie, then the winner is the one who has the most pieces still on the board. If this rule does not produce a winner, then a draw is declared.

(e) Rules for 2 or 3 players

Figure 5:
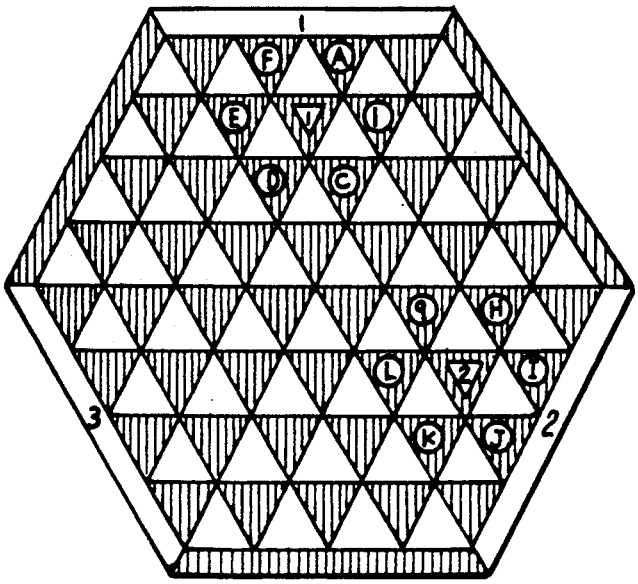
FIG. 5 is a plan view of the board of FIG. 2, showing possible moves for a playing piece.

Players decide who starts and then make alternate moves. Tri's can only move onto black triangles in a maximum of four directions. They can move sideways or forwards of their current position relative to the base line of their own colour. For example, in FIG. 5, there are six adjacent black triangles to the Tri of colour 1, these being A,B,C,D,E and F. The four directions that this Tri can move from its current position are to triangle B or E, because that direction is parallel to the base line for its colour, and to triangles D or C because that direction is forward relative to its base colour. Moving onto triangles F or A would be moving backwards relative to its base line and is thus not allowed. Similarly, the legal moves for the Tri of colour 2 are to triangles K,H,G and L, because they are parallel to or forwards of the base line for colour 2.

When a player succeeds ln moving a Tri onto one of the four black triangles adjacent to an edge whose colour is different from his own, then it is promoted to a "King". Kings can move in any direction and are identified by placing a black triangular crown around the neck. A Tri can only be promoted at the end of its move.

The rules for capturing opponents pieces are similar to those in checkers. A player can capture one or more of his opponents pieces if, on his turn to move, an opponents piece is on a triangle adjacent to one of his pieces, and there is a vacant triangle on the opposite side of it for him to land on. The vacant triangle must be adjacent to the piece being captured and the three triangles (the one the attacking piece is on, the one the piece being captured is on and the vacant one the attacking piece will land on) must all be in a straight line. Pieces cannot be captured if the attacking piece has to "turn a corner". Players are not allowed to jump over or capture their own pieces. Pieces can only be captured when the attacking piece is moving in a legal direction relative to its base line, unless the attacking piece has been promoted to a King. There is no limit to the number of opponents pieces that can be captured in any one move provided all of the above conditions have been met. Any player who is given the opportunity to capture a piece must do so, or else he will be ruled out of the game and his pieces taken off the board. A player presented with a choice of captures can of course select the most beneficial.

(f) Rules for 4 players

These are exactly the same as for 2 or 3 players except for the method of promoting Tri's. When there are 4 players, Tri's are promoted to Kings by landing on a black triangle with a side or corner touching any of the three edges in the opposite half of the board to their base line. There are fourteen possible "promotion" triangles for each player to aim at. For instance, in FIG. 1, player 1 can promote his Tri's by landing on any black triangle which touches edges 6,3 and 4. Player 2 can promote his Tri's by landing on any black triangle which touches edges 3,4 and 5.

I claim:

1. Game comprising:

(a) a game board having a playing configuration provided on the surface of the board, the playing configuration comprising an irregular hexagon subdivided into a tessellated arrangement of equilateral triangles which alternate in type along rows thereof, each edge of each triangle, being parallel to a pair of respective opposed sides of said hexagon, the hexagon being such that only one axis passing through non-adjacent vertices of the hexagon is parallel to any of the sides of the hexagon; and (b) two to four sets of playing pieces, each set comprising at least seven said pieces.

2. Game apparatus according to claim 1, wherein each said set of playing pieces comprises ten pieces.

3. Game apparatus according to claim 1, wherein said irregular hexagon comprises sides of lengths, successively in order around the periphery thereof, of four, five, five, five, four and six edges of said triangles.

4. Game apparatus according to claim 1, in which the game board is provided with one slit extending from an apex of the hexagon along edges of triangles of the two types and five radial hinged edges extending from the remaining five apices along edges of triangles of the two types to a point at which six triangles meet, such that the board can be folded into six stacked triangular flaps each of which contains at least 16 of the above-mentioned triangles.

5. Game apparatus according to claim 1, wherein at least three of said sides of said hexagon are each further contiguous with a peripheral zone of a respective distinguishing color, with each of at least three sets of playing pieces corresponding to a respective said distinguishing color.

6. Game apparatus, comprising:

(a) a game board having a playing configuration provided on a surface of the game board, the playing configuration comprising a regular hexagon subdivided into a tessellated arrangement of equilateral triangles which alternate in type along the entire length of all rows thereof, each edge of each triangle being parallel to two respective opposed sides of said hexagon, the number of either type of said triangles contiguous with each side of said hexagon being at least four, said game board being provided with a slit extending from an apex of the hexagon along edges of triangles of the two types and five radial hinged edges of triangles of the two types and five apices of the hexagon along edges of triangles of the two types to a point at which six triangles meet so that the game board is foldable into six stacked triangular flaps, each of which contains at least sixteen of said triangles; and (b) two to four sets of playing pieces with each of said sets comprising at least seven of said playing pieces.

7. Game apparatus according to claim 6, wherein each said set of playing pieces comprises ten pieces.

8. Game apparatus according to claim 6, wherein said hexagon is regular and divided into 96 of said triangles, 48 of each type.

9. Game apparatus according to claim 6, wherein at least three of said sides of said hexagon are each further contiguous with a peripheral zone of a respective distinguishing color, with each of at least three sets of said playing pieces corresponding to a respective said distinguishing color.

10. Game apparatus, comprising:

(a) a reversible game board having a playing configuration provided on both a first surface and a second surface, each playing configuration comprising a hexagon subdivided into a tessellated arrangement of equilateral triangles which alternate in type along rows thereof, one of said hexagons being regular and another of said hexagons being irregular, said game board being provided with a slit extending from an apex of the hexagon along edges of triangles of the two types and five radial hinged edges extending from the remaining five apices along edges of triangles, the two types to a point at which six triangles meet, so that the reversible game board is foldable into six stacked triangular flaps each of which containing at least sixteen of said triangles; and, (b) two to four sets of playing pieces, each of said sets of playing pieces comprising at least seven of said playing pieces.

11. Game apparatus according to claim 22, wherein each said set of playing pieces comprises ten pieces.

12. Game apparatus according to claim 22, in which the playing pieces are tetrahedron-shaped.

13. Game apparatus according to claim 22, which further comprises means for indicating enhanced value for at least some of the pieces in each of said sets.

14. Game apparatus according to claim 22, wherein said regular hexagon is divided into 96 of said triangles, 48 of each type.

15. Game apparatus according to claim 22, wherein said irregular hexagon comprises sides of lengths, successively in order around the periphery thereof, of four, five, five, five, four and six edges of said triangles.

16. Game apparatus according to claim 10, wherein at least three sides of said hexagon are further contiguous with a peripheral zone of a respective distinguishing color, with each of at least three of said sets of playing pieces corresponding to a respective of said distinguishing color.

17. Game apparatus, comprising:

(a) a game board having a playing configuration provided on a surface of the game board, the playing configuration comprising an irregular hexagon subdivided into a tessellated arrangement of equilateral triangles which alternate in type along the entire length of all rows thereof, each edge of each triangle being parallel to two respective opposed sides of said hexagon, the number of either type of said triangles contiguous with each side of said hexagon being at least four, the sides of said hexagons being of lengths successively in order around the periphery thereof of four, five, five, five, four and six edges of said triangles, at least three of said sides of said hexagon each being further contiguous with a peripheral zone of a respective distinguishing color; and, (b) two to four sets of playing pieces, each of said sets of playing pieces comprising at least seven said pieces, at least three of which sets correspond to a respective said distinguishing color.

18. Game apparatus according to claim 17, wherein each of said sets of playing pieces comprises ten pieces.

* * * * *